US006389996B1

(12) United States Patent
Mai et al.

(10) Patent No.: US 6,389,996 B1
(45) Date of Patent: May 21, 2002

(54) INCINERATOR

(76) Inventors: Sung-Chuan Mai; Chun-Jen Lu; Chan-Chia Mai, all of 87 Tsoying Big Road, Kaohsiung; Jen-Feng Wang, 87 Tsoying Big Road, Kaohsung, all of (TW)

( * ) Notice: Subject to any disclaimer, the term of this patent is extended or adjusted under 35 U.S.C. 154(b) by 0 days.

(21) Appl. No.: 09/900,544

(22) Filed: Jul. 6, 2001

(51) Int. Cl.[7] ..... F23M 5/00; F26G 5/46

(52) U.S. Cl. ..... 110/308; 110/314; 110/235; 110/238; 110/348; 110/336

(58) Field of Search ..... 110/235, 238, 110/241, 246, 314, 322, 346, 348, 336, 337, 297, 301, 302, 308; 122/6 A, 1 L, 1 B

(56) References Cited

U.S. PATENT DOCUMENTS 271,989 A * 2/1883 Ritchie
1,972,100 A * 9/1934 Lucke
4,481,014 A * 11/1984 Dorling
5,727,482 A * 3/1998 Young
6,131,525 A * 10/2000 Myers
6,189,462 B1 * 2/2001 Ishida et al.
6,269,754 B1 * 8/2001 Ruegg et al.

* cited by examiner

*Primary Examiner*—Ira S. Lazarus
*Assistant Examiner*—K. B. Rinehart
(74) *Attorney, Agent, or Firm*—Connolly Bove Lodge & Hutz LLP

(57) ABSTRACT

A incinerator comprises a framework, a liquid-vapor tank, a plurality of liquid tanks, and at least two fluid dryer tanks. The framework provides a plurality of elongated horizontal frames fixedly attached to a front and a rear walls thereof respectively. The liquid-vapor tank strides the framework and occupies a top area thereof. The liquid tanks each are disposed under the liquid-vapor tank and occupy a space confined by two neighboring horizontal frames respectively. The fluid dryer tanks each are disposed below the liquid tanks. The liquid from the liquid source may enter the liquid tanks and the liquid-vapor tank and a specific water level may be maintained constantly. The vapor can move outward from the vapor discharge pipes and is collected for further use and the dense fluid can be filled into the fluid dryer tanks and is dried up slowly and to be recycled for the energy saving and the environment protection.

9 Claims, 7 Drawing Sheets

INCINERATOR

BACKGROUND OF THE INVENTION

1. Field of the Invention

The present invention relates to an incinerator, and particularly, to an incinerator, which provides fluid tanks to form the furnace wall thereof and to absorb the heat from the discarded articles burned therein. Hence, the heated fluid and the exhaust then can be recycled to save energy and to protect the environment from being contaminated.

2. Description of Related Art

It is known that the conventional incinerator provides a furnace wall thereof made of heat insulation material such as the refractory bricks so that it is costly and complicated while it is fabricated. Further, the most part of the thermal energy generated in the incinerator is not possible to be utilized effectively such that it results in a waste of energy and a contamination of environment. In order to utilize the thermal energy generated in the incinerator, the furnace body in an incinerator of the prior art is provided with double water walls to contain cooling water. However, the prior art is only for cooling the furnace body without reusing the thermal energy and the size of the incinerator is unable to be arranged flexibly. Another incinerator of the prior art provides an inner and an outer furnace walls with an inner combustion chamber, and a hot water recycled stove is disposed above the furnace body to communicate with the inner and the outer furnace walls by way of pipelines. However, the cooling water circulating between the outer and the inner furnace walls is only to perform the temperature reduction of the furnace body and there is no any other function offered. The present invention aims to overcome the shortcoming resided in the prior art and develops an innovative incinerator, which is not only to enhance the function of incinerator but also to lower down the environment being contaminated.

SUMMARY OF THE INVENTION

The crux of an incinerator according to the present invention resides in that the furnace body in the incinerator is a framework with multiple box like tanks filled with liquid, and dense fluid respectively such that the heat generated during the discarded articles being burned in the incinerator can heat up the fluid in the tanks for further uses so as to expand the functions of the incinerator. In addition, the present invention can be associated with U.S. Pat. No. 5,298,043 owned by one of the present inventors so that it is possible to offer not only an effect of energy saving but also a function of preventing from second contamination.

Accordingly, an object of the present invention is to provide an incinerator, which has a furnace body thereof composed of fluid tanks supported by a framework and it is easy to be set up with a high adaptability and low fabricating cost.

Another object of the present invention is to provide an incinerator, which is possible to dry up the sewage sludge after a treatment of dirty water for a further use so as to prevent from occurring a second contamination.

A further object of the present invention is to provide an incinerator, which is possible to be made with any size adaptable to any specific available space.

A further object of the present invention is to provide an incinerator system, which has a plurality of incinerators of the present invention joining in series with a rail therein such that the burning discarded articles can be moved slowly along the rail in case of a longer burning being needed instead of burning at a fixed place to avoid a phenomenon of overheating.

BRIEF DESCRIPTION OF THE DRAWINGS

The present invention can be more fully understood by referencing to the following description and accompanying drawings, in which.

DETAILED DESCRIPTION OF THE PREFERRED EMBODIMENTS

Figure 1:
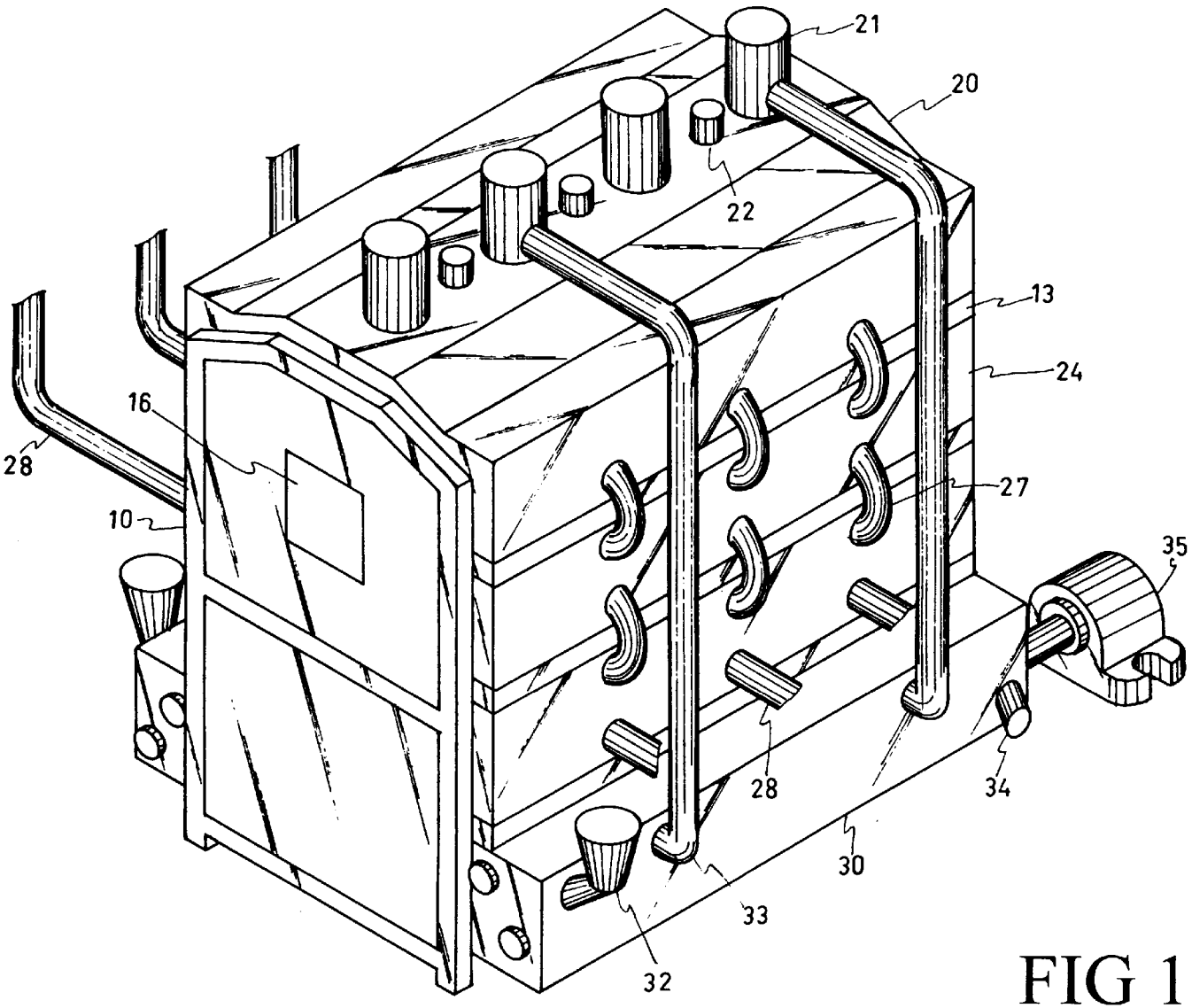
FIG. 1 is a perspective view of an incinerator according to the present invention in a first embodiment thereof.
Figure 2:
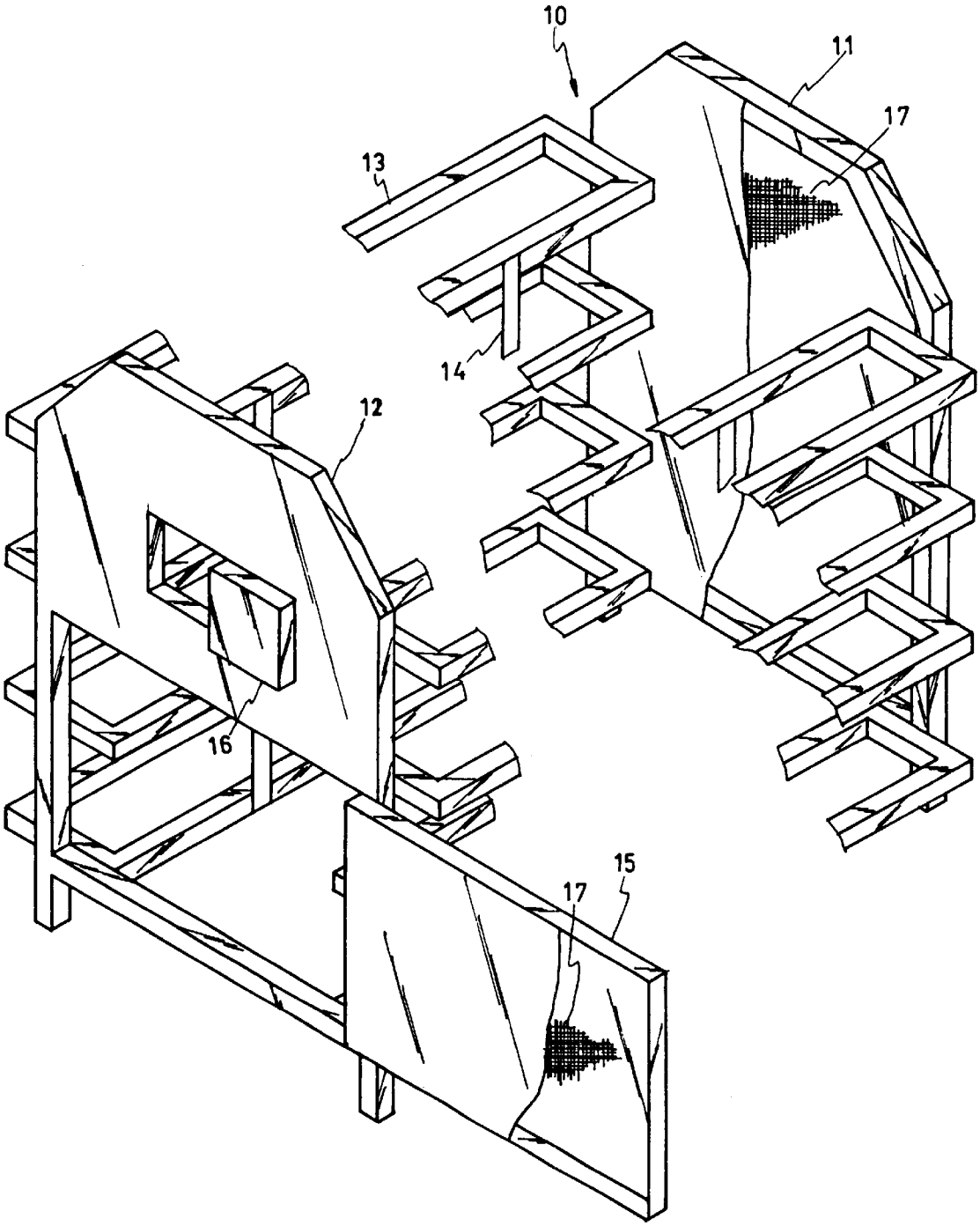
FIG. 2 is a fragmentary perspective view of a framework in the incinerator shown in FIG. 1.

Referring to FIGS. 1 and 2, an incinerator according to the present invention in the first embodiment thereof basically comprises a framework 10, a liquid-vapor tank 20, a plurality of liquid tanks 24, and at least two fluid dryer tanks 30. The framework 10 further comprises a rear wall 11, a front wall 12, and a plurality of elongated frames 13 between the rear and the front walls 11, 12. The elongated frames 13 are divided into two opposite columns to correspond to each other and the elongated frames 13 are disposed to space apart from each other and line up vertically respectively such that both ends of the respective elongated frame 13 are fixedly attached to the front and the rear walls respectively. In order to keep the respective elongated frame 13 in place firmly, the elongated frames at the inner side thereof are attached with several parallel retaining bands 14. The rear and the front walls 11, 12 are hollow and filled with heat insulation material 17, and the front wall 12 has a furnace door 15 and an upper observation window 16. Spaces constituted in each column of elongated frames 13 are available for placing the liquid tanks 24 and the fluid dryer tanks 30 is placed at the lower most space thereof. The discards can be thrown into the incinerator as soon as the furnace is opened, and the operator can check the state of the burning flames through the observation window 16.

Figure 3:
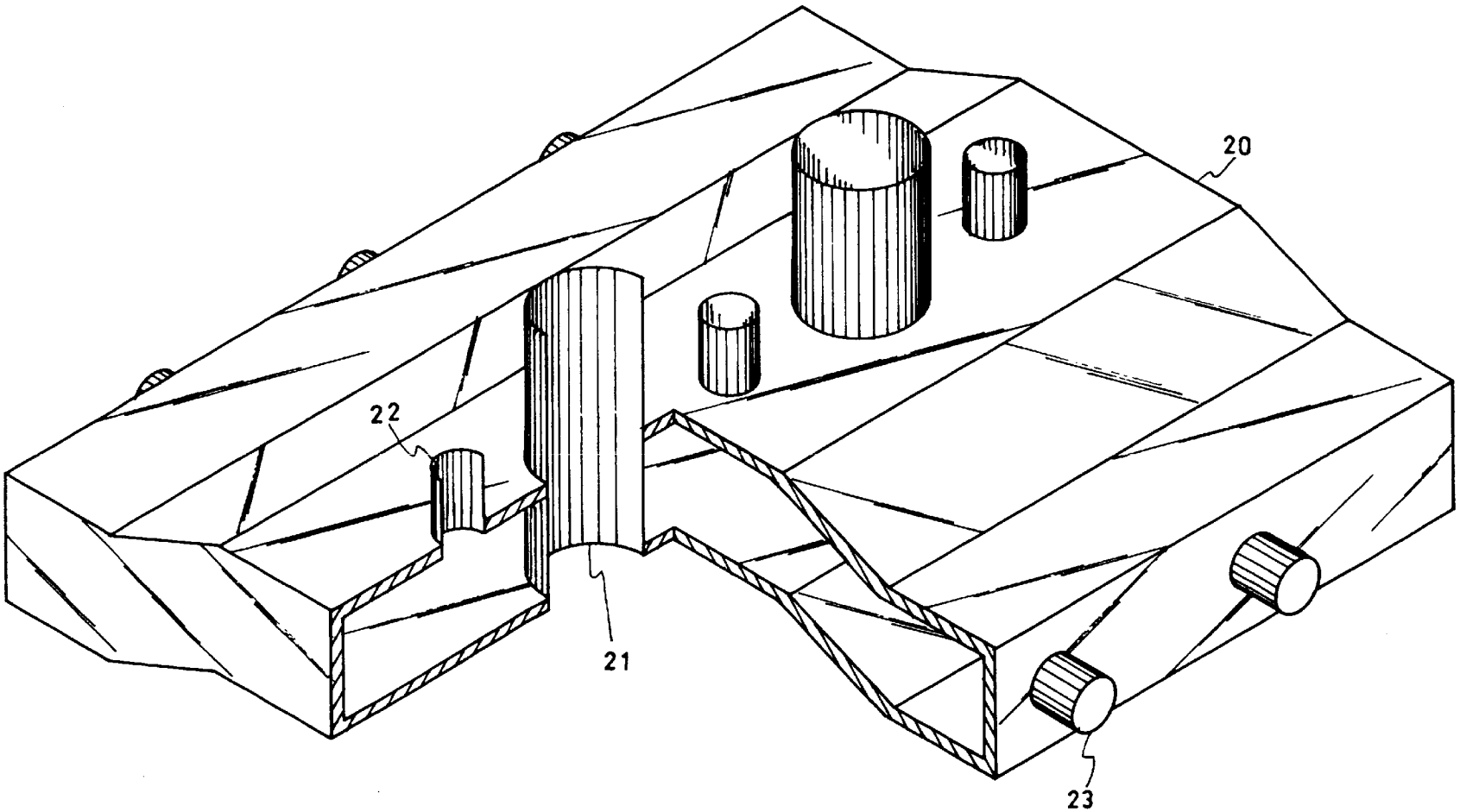
FIG. 3 is a perspective view of a liquid-vapor tank in the incinerator shown in FIG. 1.

Referring to FIG. 3 and accompanying with FIGS. 1 and 2 again, the liquid-vapor tank 20 is disposed to stride the two columns of elongated frames and rests on the upper most elongated frames 13 thereof such that the liquid-vapor tank 20 at both lateral sides thereof has a lower flattened bottom respectively to contact with the upper most elongated frames 13 stably. The liquid-vapor tank 20 at the middle portion thereof provides several upright exhaust pipes 21 extending through the bottom thereof so that the exhaust generated in the incinerator can move outward through the exhaust pipes 21. The exhaust pipes 21 can connect with any type of exhaust filtering apparatus such as the filter system disclosed in the U.S. Pat. No. 529,804 owned by one of the present inventors for a further treatment. Several vapor discharge pipes are provided on the liquid-vapor tank 20 next to the exhaust pipes 21 respectively, and the vapor therein can move out and be collected for being utilized in the exhaust filtering system. Furthermore, the liquid-vapor tank 20 at the lateral sides thereof provides a plurality of inlet ports 23 to communicate with the liquid tanks 24 so that the liquid in the liquid tanks 24 can flow upward to enter the liquid-vapor tank 20 by way of a pressure head of liquid source while the incinerator of the present invention is in operation.

Figure 4:
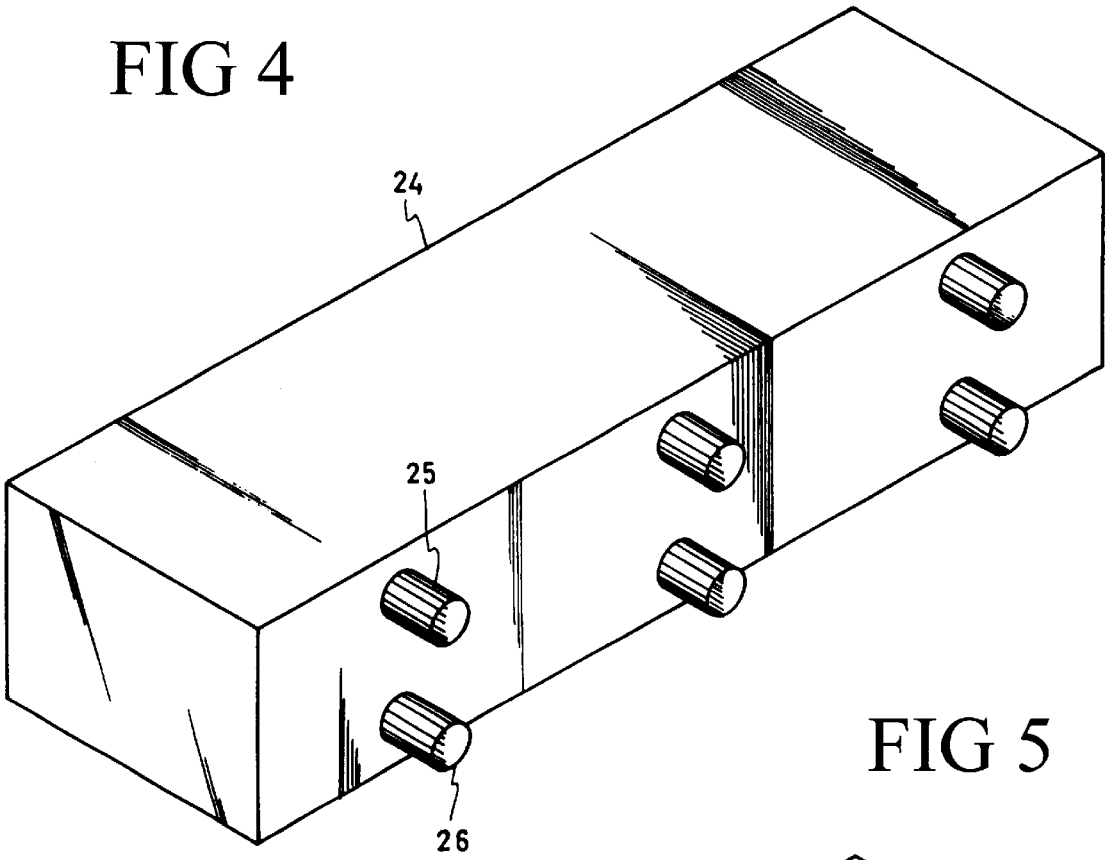
FIG. 4 is a perspective view of a liquid tank in the incinerator shown in FIG. 1.

Referring to FIG. 4 and accompanying with FIG. 1 again, one of the liquid tanks 24 is illustrated and it can be seen that the liquid tank 24 has a size corresponding to the space between two neighboring elongated frames 13 in the same column. Thus, the liquid tanks 24 can be disposed in each column of elongated frames 13 under the liquid-vapor tank 20. There are two liquid tanks 24 in the respective column of elongated frame as illustrated in FIG. 1, but it is noted that the number of liquid tanks shown in FIG. 1 is only an explanatory example and is not for a limitation. In order to connect with the adjacent liquid tank 24, the liquid tank 24 provides a plurality of upper outlet ports 25 and a plurality of lower inlet ports 26 at the outer side thereof. It is noted that the lower most liquid tank 24 has the lower ports 26 thereof communicate with the liquid source via a plurality of liquid input pipes 28, and the upper most liquid tank 24 has the outlet ports 25 thereof connect with the inlet ports 23 of the liquid-vapor tank 24 via a plurality of connecting pipes 27 such that liquid-vapor tank 24 can communicate with the liquid tank 24.

Figure 5:
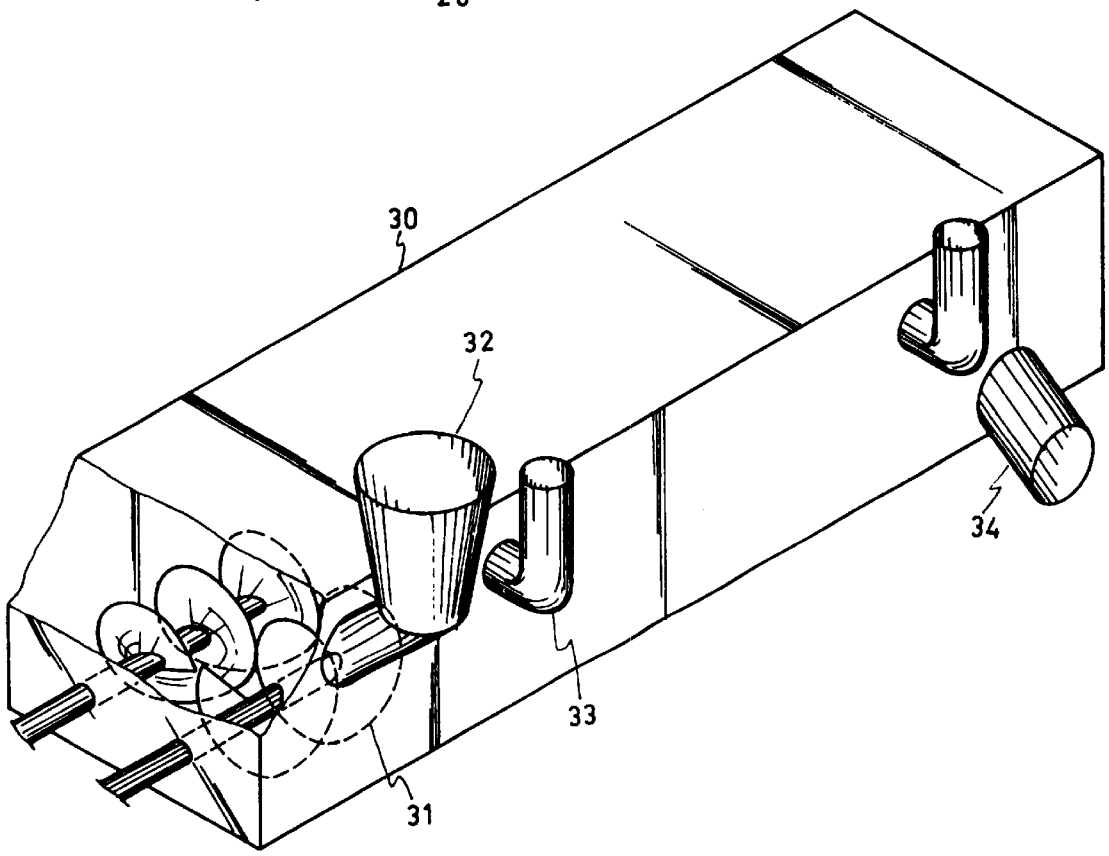
FIG. 5 is a perspective view of a fluid dryer tank in the incinerator shown in FIG. 1.

Referring to FIG. 5 and accompanying with FIG. 1 again, the respective fluid dryer tank 30 is disposed under the lower most liquid tank 24 and occupies the space above the lower most elongated frame 13 in each column of elongated frames 13. The fluid dryer tank 30 provides an agitator device 31 therein and a fluid inlet port 32, a plurality of gas discharge pipe 33, and an outlet port 34. A dense fluid such as sewage sludge can be poured into the fluid dryer tank 30 through the fluid inlet port 32 and the agitator device 31 provides spiral agitator to move the fluid toward the outlet port 34. While the incinerator of the present invention is in operation, the heat generated in the incinerator may heat up the dense fluid in the fluid dryer tank 30 such that the dirty gas out of the dense fluid can be discharged through the respective gas discharge pipe 33. The gas discharge pipes 33 connect with the exhaust pipes 21 on the liquid-vapor tank 20 such that the dirty gas can be removed, and the dense fluid can be dried up gradually as solidified substance to move outward from the outlet port 34. The solidified substance out of the outlet port 34 can be recycled for further use to avoid a second contamination. Alternatively, a further liquid tank 24 can be used instead of the fluid dryer tank 30 or a further fluid dryer tank 30 can be used instead of the lower most liquid tank as needed.

Referring to FIG. 1 again, when the first embodiment of the present invention is in practice, the liquid-vapor tank 20 is arranged to rest on the top of the framework 10 and the size of the bottom thereof occupies the entire area of the top of the framework 10, and the space between two neighboring elongated frames is occupied by a liquid tank or a fluid dryer tank 30. At least a liquid tank 24 is provided in each column of elongated frames above the fluid dryer tank 30 and below the liquid-vapor tank 20. Each inlet port 23 on the liquid-vapor tank 30 communicates with a corresponding outlet port 25 on the respective upper most liquid tank 24 by way of a connecting pipe 27. Each inlet port 26 on the respective lower most liquid tank 24 communicates with a liquid source such as a water tower by way of the liquid input pipe 28. By the same token, Each intermediate liquid tank 24 between the upper most and the lower most liquid tanks can communicate with each other <by way of a respective connecting pipe 27 connecting with an inlet port 26 of the liquid tank above and a corresponding outlet port 25 of the liquid tank below. Thus, the liquid from the liquid source can be flowed into the liquid tanks and the liquid-vapor tank 20 respectively through the connecting pipes 27 and the liquid input pipes 28. Due to the pressure head of the liquid source, a constant water level in the liquid-vapor tank 20 can be maintained and a space above the water level is left for being occupied by the vapor temporarily such that the vapor resulting from the evaporation of the liquid can move outward through the vapor discharge pipes 22. Because the gas discharge pipes 33 on the respective fluid dryer tank 30 are connected to the exhaust pipes 21 respectively, the dirty gas can be discharged through the exhaust pipes and can be cleaned by the exhaust filter system (not shown). The sewage sludge coming from the sewage treatment device of the exhaust filter system can be received in the fluid dryer tank through the fluid inlet port 32 for being dried and a driving means is provided to run the agitator device 31 to move the sludge toward the outlet 34 along with the operation of processing the drying job.

Figure 6:
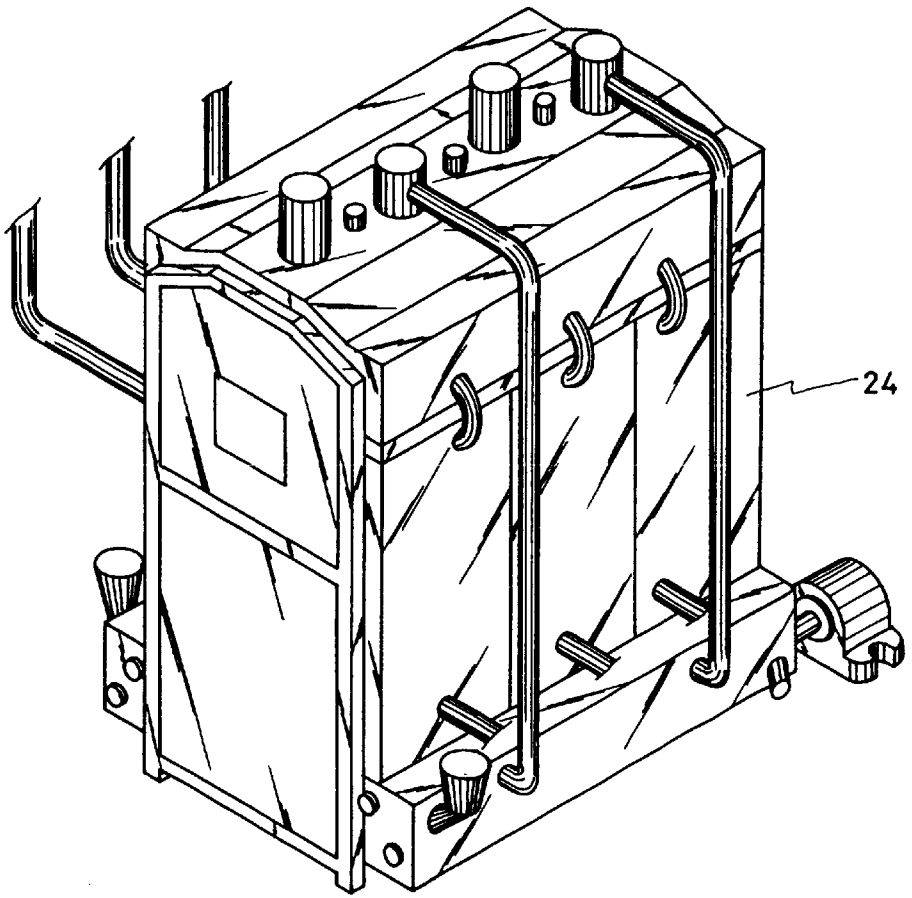
FIG. 6 is a perspective view of an incinerator according to the present invention in a second embodiment thereof.

Referring to FIG. 6, a second embodiment of the present invention is illustrated and the only difference of the incinerator from the first embodiment shown in FIG. 1 is the liquid tanks are disposed vertically side by side between two elongated frames instead of a single liquid tank being disposed between two elongated frames.

Figure 7:
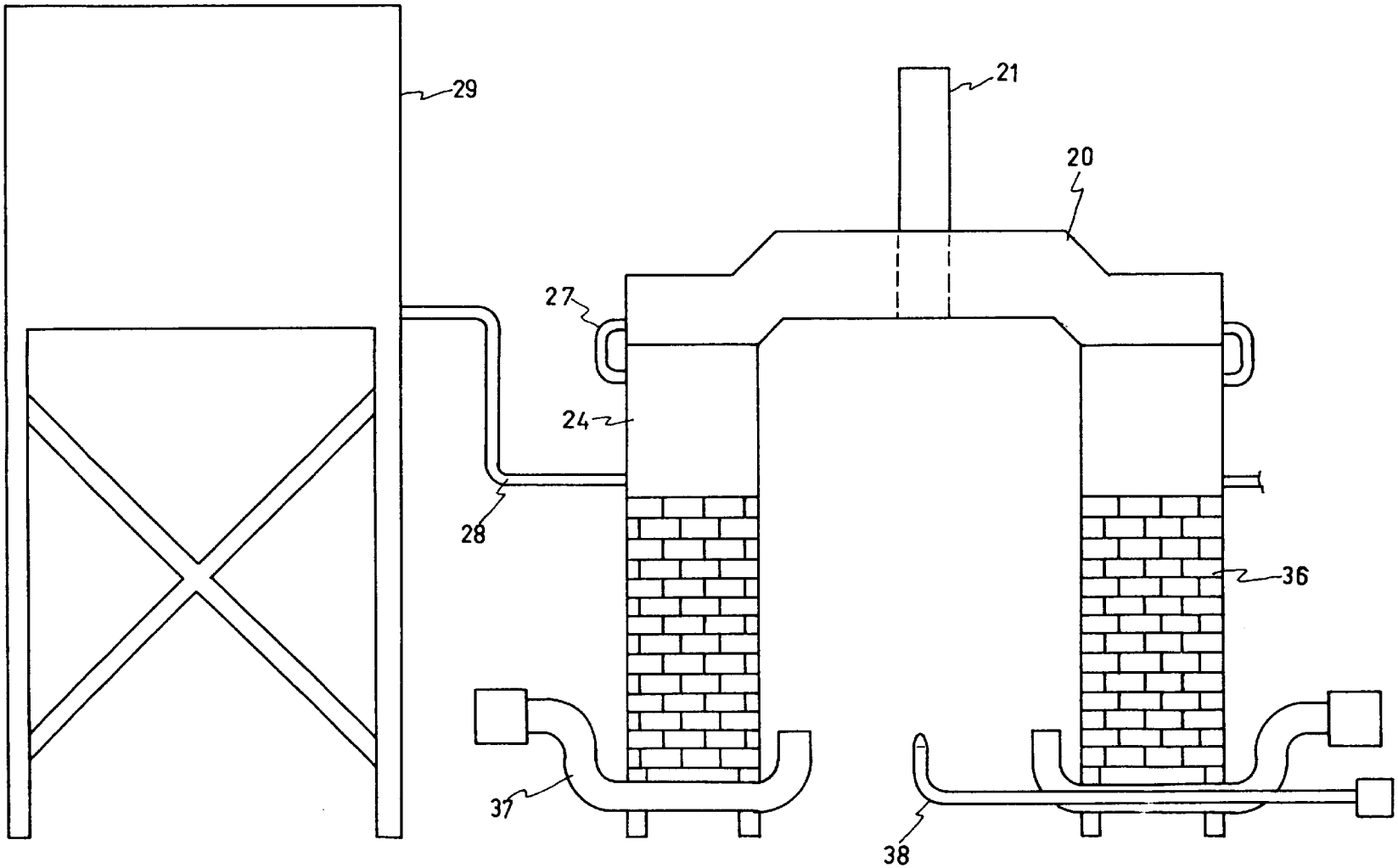
FIG. 7 is a plan view of an incinerator according to the present invention in a third embodiment thereof.

Referring to FIG. 7, a third embodiment of the present invention is illustrated. It can be seen that the respective liquid tank 24 at the bottom thereof is supported by conventional refractory bricks. The liquid-vapor tank 20 communicates with the liquid tanks 24 byway of the connecting pipes 27 as the first embodiment does. The respective liquid tank 24 further connects with the water tower 29 by way of the liquid input pipe. In addition, an air inlet pipe 37 is arranged to be located under the respective refractory. Furthermore, an ignition pipe 38 is provided below the refractory bricks too.

Figure 8:
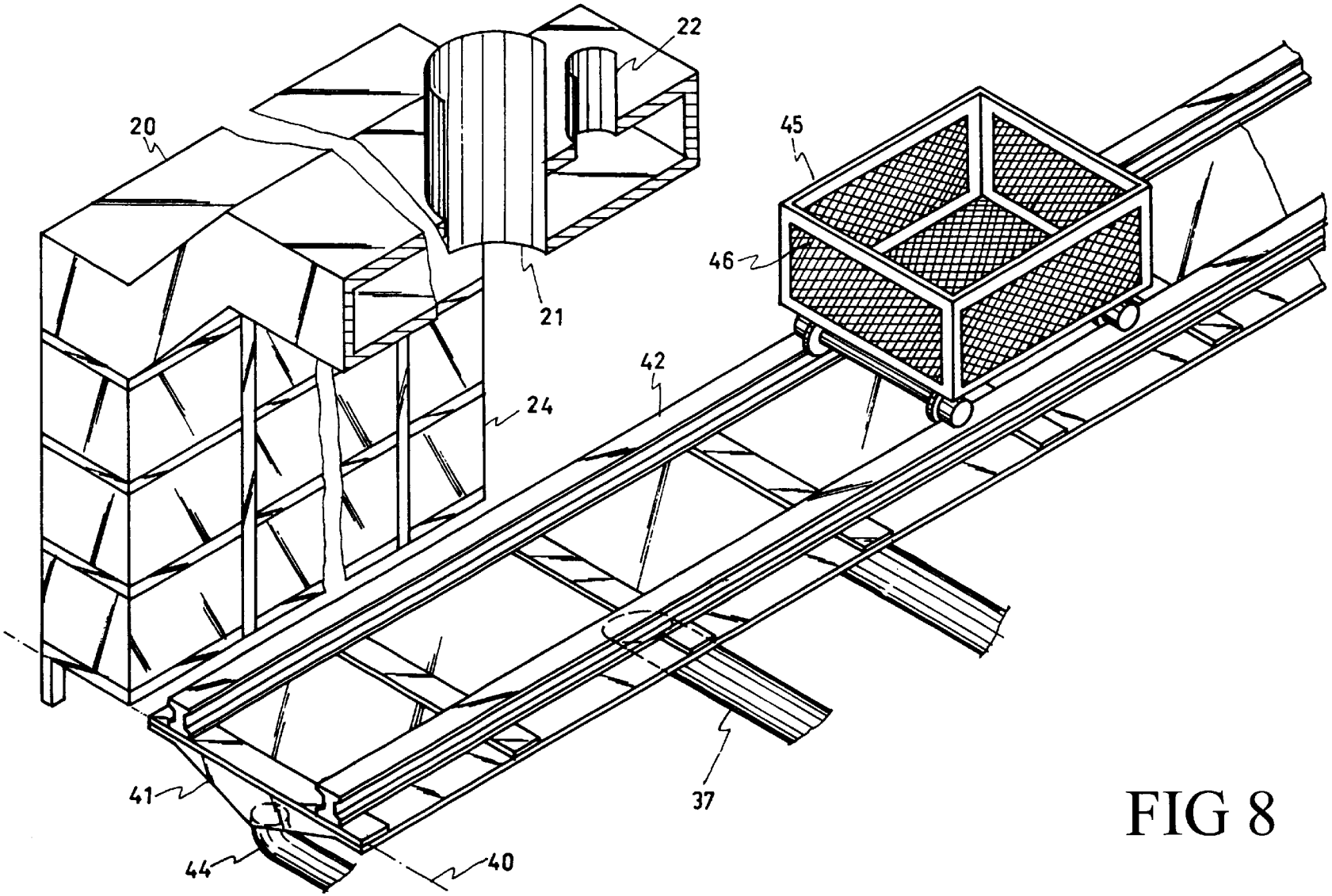
FIG. 8 is partial perspective of an incinerator according to the present invention in a fourth embodiment thereof.

Referring to FIG. 8, a fourth embodiment of the present invention is illustrated. The fourth embodiment discloses an incinerator system and the incinerator basically comprises a plurality of incinerators shown in FIG. 1 or FIG. 5, a rail with double tracks 42, an oil collect pan 41, and at least a collect cart 45. The incinerators are lined up in series and there is no front wall is provided for the incinerators except the first incinerator, and no rear wall is provided f or the incinerators except the last incinerator. The rail 42 is disposed in the incinerator system at the middle lower part thereof on the ground level 40 and extends along the lined up incinerators with a slight slop. The collect cart 45 provides a porous periphery 46 including four sides and a bottom thereof for containing discarded articles such that it is possible for the collect cart 45 to move slowly along the rail from the first incinerator to the last incinerator during the discarded articles being burned in the collect cart 45. Of course, two or more carts 45 can be used instead of a single cart 45. The oil collect pan 41 is disposed under the rail 42 to collect the oil residue from the collect cart or the collect carts due to the discarded articles in the collect cart 45 being burned. The oil collect pan 41 at the bottom thereof is attached with a plurality of drain pipes for discharging the oil residue properly. The incinerator system is suitable for treating a large amount of discarded articles. The exhaust generated can move outward through the exhaust pipes 21 and can be treated by the exhaust filter system so as to remove the harmful part in the exhaust. Due to the collect cart 45 moving slowly, the heat resulting from burning the discarded articles can be distributed to the respective incinerator so that the heat of high temperature staying at a fixed place in the incinerator system can be avoided and a damage resulting from overheating can be prevented so that the life span of the incinerator can be extended longer. Moreover, the oil residue may drip onto the oil collect pan along with the moving collect cart such that the oil residue may distribute over the oil collect pan instead of dripping at a fixed place. In this way, the drain pipe 44 may not blocked by the oil residue so that the cleaning job for the oil collect pan and the drain pipes can be performed easily.

It is appreciated that the incinerator of the present invention provides a wide range of use, that is, the incinerator of the present invention is suitable for treating household discarded articles and for harmful industrial discarded articles such as the scrap metals and the useless tires. Furthermore, the incinerator of the present invention not only can treat discarded articles but also can utilize the heat generated therein to recycle the treated dirty substance. Hence, the incinerator is useful for energy saving and environment protection in addition to the basic function of burning the discarded articles. Moreover, the incinerator of the present invention provides a simple construction to be fabricated with a less cost. Therefore, these advantages offered by the present invention are not possible for the conventional art to reach effectively.

While the invention has been described with reference to preferred embodiments thereof, it is to be understood that modifications or variations may be easily made without departing from the spirit of this invention, which is defined in the appended claims.

What is claimed is:

1. A incinerator comprising:

a framework, providing a front wall, a rear wall, and a plurality of elongated frames, the elongated frames being disposed between the front and the rear walls and being arranged into two opposite columns corresponding to each other, the elongated frames in each column spaced apart from each other with an equal distance to constitute a plurality of spaces, the front wall capable of being opened, and the respective elongated frame at both ends thereof being fixedly attached horizontally to the front wall and the rear wall;

a liquid-vapor tank, providing a shape of an elongated box with two opposite lateral sides, the lateral sides having a flat bottom respectively to span an upper most elongated frame in each of the columns of elongated frames, a top area of the framework being occupied by the liquid-vapor tank completely, at least one exhaust pipe passing through a bottom at a middle portion thereof and extending outward vertically, at least one vapor discharge pipe next to the exhaust pipe, and a plurality of inlet ports being provided on an outer side of the lateral sides respectively;

a plurality of liquid tanks, the liquid tanks each providing a shape of an elongated box respectively, the liquid tanks being disposed under the liquid-vapor tank and occupying the spaces in each of the columns of elongated frames, and a plurality of inlet ports and a plurality of outlet ports being provided at a lateral side of the respective liquid tank, the outlet ports on a respective upper most liquid tank connecting with the inlet ports on the liquid-vapor tank via a connecting pipe respectively, the inlet ports on a lower most liquid tank in each column of elongated frames connecting with a liquid source via a liquid entering pipe respectively, and all adjacent liquid tanks in each column connecting with each other also by way of a respective inlet port connecting with a corresponding outlet port via further connecting pipes; and at least two fluid dryer tanks, the fluid dryer tanks each providing a shape similar to each of the liquid tanks, occupying a lower most one of the spaces in each column of the elongated frames respectively, an agitator device being mounted in the respective fluid dryer tank, the respective fluid dryer tank at an outer side thereof providing an inlet port for dense fluid, an outlet port for a dried substance;

whereby, the liquid from the liquid source may enter the liquid tanks and the liquid-vapor tank and a specific water level may remain constant due to a pressure head of the liquid source so that a space above the water level in the liquid-vapor tank is occupied by the vapor; the vapor can move outward from the vapor discharge pipes and is collected for further use; and a dense fluid in the fluid dryer tanks can be dried slowly due to the heat generated from discarded articles being burned in the incinerator and the agitator device enhances the drying job and moves the dried substance to the outlet port on the respective fluid dryer tank.

2. The incinerator according to claim 1, wherein the liquid tanks can be replaced by way of the fluid dryer tanks.

3. The incinerator according to claim 1, wherein the fluid dryer tanks can be replaced with the liquid tanks.

4. An incinerator, comprising:

a framework, providing a front wall, a rear wall, and a plurality of elongated frames, the elongated frames being disposed between the front and the rear walls and being arranged into two opposite columns corresponding to each other, the elongated frames in each column spaced apart from each other with an equal distance to constitute a plurality of spaces, the front wall capable of being opened, and the respective elongated frame at both ends thereof being fixedly attached horizontally to the front wall and the rear wall;

a liquid-vapor tank, providing a shape of an elongated box with two opposite lateral sides, the lateral sides having a flat bottom respectively to span an upper most elongated frame in each of the columns of elongated frames, a top area of the framework being occupied by the liquid-vapor tank completely, at least one exhaust pipe passing through a bottom at a middle portion thereof and extending outward vertically, at least one vapor discharge pipe next to the exhaust pipe, and a plurality of inlet ports being provided on an outer side of the lateral sides respectively;

a plurality of liquid tanks, the liquid tanks each providing a shape of an elongated box respectively, the liquid tanks being disposed under the liquid-vapor tank and occupying the spaces in each of the columns of elongated frames, and a plurality of inlet ports and a plurality of outlet ports being provided at a lateral side of the respective liquid tank, the outlet ports on a respective upper most liquid tank connecting with the inlet ports on the liquid-vapor tank via a connecting pipe respectively, the inlet ports on a lower most liquid tank in each column of elongated frames connecting with a liquid source via a liquid entering pipe respectively, and all adjacent liquid tanks in each column connecting with each other also by way of a respective inlet port connecting with a corresponding outlet port via further connecting pipes;

at least two fluid dryer tanks, the fluid dryer tanks each providing a shape similar to each of the liquid tanks, occupying a lower most one of the spaces in each column of the elongated frames respectively, an agitator device being mounted in the respective fluid dryer tank, the respective fluid dryer tank at an outer side thereof providing an inlet port for dense fluid, an outlet port for a dried substance; and two refractory lateral walls, being disposed at a bottom of each of the columns of elongated frames respectively and next to a respective fluid dryer tank in each of the two columns of elongated frames;

whereby, the liquid from the liquid source may enter the liquid tanks and the liquid-vapor tank and a specific water level may remain constant due to a pressure head of the liquid source so that a space above the water level in the liquid-vapor tank is occupied by the vapor; the vapor can move outward from the vapor discharge pipes and is collected for further use; a dense fluid in the fluid dryer tanks can be dried slowly due to the heat generated from discarded articles being burned in the incinerator and the agitator device enhances the drying job and moves the dried substance to the outlet port of the respective fluid dryer tank.

5. The incinerator according to claim 4, wherein the fluid dryer tanks can be replaced with the liquid tanks.

6. The incinerator according to claim 4, wherein the liquid tanks can be replaced with fluid dryer tanks.

7. An incinerator system, comprising a framework assembly, being composed of a plurality of frameworks in conjunction with one another in series, each of the frameworks providing a front upright frame, a rear upright frame, and a plurality of elongated horizontal frames, the elongated frames being disposed between the front and the rear frames and being arranged into two columns corresponding to each other, the elongated frames in each column spaced apart with an equal distance to constitute a plurality of spaces and at both ends thereof being fixedly attached to the front upright frame and the upright rear frame, a front most framework of the framework assembly providing a front wall capable of being opened, and rear most framework of the framework assembly providing a rear wall;

a plurality of liquid-vapor tanks, being disposed on the frameworks at a top area thereof respectively, each of the liquid-vapor tanks providing a shape of an elongated box with two opposite lateral sides, the lateral sides having a flat bottom respectively to span an upper most elongated frame of each column elongated frame, the top area of the framework being occupied by the liquid-vapor tank completely, at least one exhaust pipe passing through a bottom at a middle portion thereof and extending outward vertically, at least one vapor discharge pipe next to the exhaust pipe, and a plurality of inlet ports being provided on an outer side of the lateral sides respectively;

a plurality of liquid tanks, the liquid tanks each providing a shape of an elongated box respectively, the liquid tanks being disposed under the respective liquid-vapor tank and occupying the spaces in each column of elongated frames respectively, and a plurality of inlet ports and a plurality of outlet ports being provided at a lateral side of the respective liquid tank, the outlet ports on a respective upper most liquid tank connecting with the inlet ports on the liquid-vapor tank via a connecting pipe respectively, the inlet ports on a lower most liquid tank in each column of elongated frames connecting with a liquid source via a liquid entering pipe respectively, and all adjacent liquid tanks in each column connecting with each other also by way of respective inlet port connecting with a corresponding outlet port via connecting pipes;

a plurality of fluid dryer tanks, the fluid dryer tanks, being disposed at a lower most space in each column of the elongated frames respectively in any one of the frameworks, an agitator device being mounted in the respective fluid dryer tank, the respective fluid dryer tank at an outer side thereof providing an inlet port for dense fluid, an outlet port for a dried substance;

a rail of double tracks, being disposed on a middle ground in the framework assembly, and extending along the framework assembly;

at least one collect cart, provided with a porous periphery, and being movable along the rail; and an elongated oil collect pan, being disposed under the rail, and providing a plurality of drain pipes;

whereby, the liquid from the liquid source may enter the liquid tanks and the liquid-vapor tanks and a specific water level may remain constant in each of the liquid-vapor tanks due to a pressure head of the liquid source so that a space above the water level in the respective liquid-vapor tank is occupied by the vapor; the vapor can move outward from the vapor discharge pipes and is collected for further use; a dense fluid in the fluid dryer tanks can be dried slowly due to the heat generated from discarded articles being burned in the incinerator and the agitator device enhances the drying job and moves the dried substance to the outlet port; the collect cart moves slowly along the rail with a plurality of discarded articles in the collect cart being burned; and the oil collect pan receives an oil residue from the burning discarded articles and the oil residue is discharged through the drain pipes.

8. The incinerator system according to claim 7, wherein the fluid dryer tanks can be replaced with the liquid tanks.

9. The incinerator system according to claim 7, wherein the liquid tanks can be replaced with the fluid dryer tanks.

* * * * *